US005586435A

United States Patent [19]

Kokalis

[11] Patent Number: 5,586,435

[45] Date of Patent: Dec. 24, 1996

[54] HYDRAULIC CLOSED LOOP CONTROL SYSTEM

[75] Inventor: George P. Kokalis, Ann Arbor, Mich.

[73] Assignee: Servo Kinetics, Ann Arbor, Mich.

[21] Appl. No.: 543,207

[22] Filed: Oct. 13, 1995

Related U.S. Application Data

[63] Continuation of Ser. No. 389,071, Jan. 3, 1995, abandoned, which is a continuation of Ser. No. 94,508, Jul. 20, 1993, abandoned.

[51] Int. Cl.[6] ..... F16D 31/02

[52] U.S. Cl. ..... 60/416; 60/413; 91/363 R; 91/365; 164/457; 164/154.2

[58] Field of Search ..... 60/413, 416, 469; 91/363 R, 365, 417 R; 164/4.1, 54.2, 457

[56] References Cited

U.S. PATENT DOCUMENTS

| | | | |
|---|---|---|---|
| 2,290,479 | 7/1942 | Mercier | 60/416 |
| 4,022,269 | 5/1977 | Segawa | 60/416 |
| 4,204,461 | 5/1980 | Gratzmuller | 91/461 |
| 4,252,176 | 2/1981 | Page | 164/4.1 |
| 4,321,435 | 3/1982 | Grieger et al. | 91/417 R |
| 4,669,265 | 6/1987 | Gratzmuller | 60/416 |
| 4,938,118 | 7/1990 | Wolfes et al. | 91/417 R |
| 5,060,475 | 10/1991 | Latimer | 60/413 |

FOREIGN PATENT DOCUMENTS

| | | | |
|---|---|---|---|
| 103913 | 6/1982 | Japan | 91/365 |
| 142664 | 5/1990 | Japan | 164/154 |

OTHER PUBLICATIONS

*Metals Handbook*, 9th Ed. Ohio, ASM International, 1988, vol. 15, p. 789, TH 472 A3 9th ed V15 c3.

Fluid Power, 3rd Ed. Indianapolis, Bobbs–Merrill Educational Publishing, 1980, pp. 442–446.

Tokyo Precision Instruments Co., Ltd., Nov., 1990 Document No. V511–890.

*Primary Examiner*—F. Daniel Lopez

*Attorney, Agent, or Firm*—Harness, Dickey & Pierce, PLC

[57] ABSTRACT

A closed loop hydraulic system especially adapted as a shot control system for a die casting machine. The control system includes a voice coil driven pilot servo valve mounted to a high flow proportional valve. The control system provides a highly controllable restriction of the outflow of hydraulic fluid from a hydraulic shot cylinder which drives a shot plunger of a die casting machine. Position transducers are provided for the pilot servo valve, proportional spool valve, and shot cylinder and a control system monitors these inputs to provide closed loop control over the shot process. A hydraulic accumulator is located in each of the pressure source and return lines of the pilot servo valve and a hydraulic accumulator tank is mounted directly to the proportional valve. The configuration of the elements of the control system along with features intended to optimize the hydraulic circuits provide a die cast shot control system with exceptionally high repeatability, frequency response and controllability coupled with low maintenance characteristics.

1 Claim, 4 Drawing Sheets

HYDRAULIC CLOSED LOOP CONTROL SYSTEM

This is a continuation application of U.S. patent application Ser. No. 08/389,071 filed Jan. 3, 1995, abandoned, which is a continuation application of United States patent application Ser. No. 08/094,508, filed Jul. 20, 1993, abandoned.

BACKGROUND AND SUMMARY OF THE INVENTION

This invention relates to a hydraulic control system and particularly to one used as a shot control system for a die-casting machine.

In the process of die-casting, molten metal such as zinc, aluminum or magnesium is forced under pressure into a closed metal die. Although the die-casting process is well understood efforts are continually being directed toward optimizing the process. In particular, the process of controlling the "shot" or the forcing of molten metal into an empty die has undergone a great deal of study. The shot process has a direct influence on final part quality. Scrap and quality degradation occur when the final part has porosity or other variations in physical properties caused by a lack of precise control over the shot process. In addition, there is a desire to reduce the flash or excess metal which remains on the part at the die parting line after it is ejected from the dies.

In an effort to improve die cast quality, manufacturers of die casting equipment have attempted to provide more precise control over the shot process. A typical die-caster has a hydraulic shot cylinder oriented either horizontally or vertically which drives a plunger which forces a volume of molten metal into the die cavity under pressure. In some machines, the dies are preheated and thus referred to as "hot chamber" machines as compared with unheated "cold chamber" machines. Efforts have centered on precisely controlling the velocity of the shot plunger at various points along its stroke. Although great strides have been made in the shot control process through the use of sophisticated servo hydraulic control systems, presently available shot control systems do not provide a repeatable shot process. Advanced systems currently available are described as closed-loop controllers but lack the characteristics necessary to provide precise repeatable control. Disadvantages of currently available shot control systems primarily relate to two areas. First, today's systems lack the frequency response necessary to enable the system to rapidly respond to differences between a desired shot cylinder plunger velocity at a particular point in its travel, and its actual velocity at that point. The limited frequency response of currently available systems also prevents the system from quickly recognizing the occurrence of the die being fully filled with molten metal which, when driven further, creates a "water hammer" effect in which a high pressure shock is applied to the casting dies. This shock causes deflection of the dies which produces excess flash on the cast part.

A second disadvantage of current systems is their degradation over time caused by impurities which are invariably present in hydraulic fluid. Conventional hydraulic servo valves either of the jet pipe or nozzle-flapper variety which are the two most popular types, are highly sensitive to contaminants. Present systems therefore have stringent hydraulic fluid filtration requirements often in the 3 to 5 micron range. Currently used shot control servo valves typically must be re-built on a very frequent basis to maintain adequate shot control. Moreover, even during the operating cycle of currently available servo valves, between servicing a gradual degradation of performance occurs between valve rebuilds. This degradation is noticed as a decrease in the valves slew rate or frequency response. Conventional jet pipe and nozzle flapper servo valves are further two stage devices which inhibits their frequency response capabilities.

In accordance with this invention, an improved die caster hydraulic shot control system is provided having a number of novel features, which when combined, produce a significant improvement over existing shot control systems. The hydraulic shot control system in accordance with this invention features a voice coil driven pilot servo valve which inherently features high frequency response. In addition, the voice coil driven pilot servo valve provides high flow capabilities which eliminates multi-stage servo valves normally required in currently available systems, further enhancing frequency response. The pilot servo of this invention is inherently contaminant tolerant which is a significant advantage in a production plant setting. The use of a pilot servo valve of this configuration coupled with a high flow shot proportional valve along with additional features combine to provide exceptional control, repeatability, stability and low maintenance in the shot control process.

Additional benefits and advantages of the present invention will become apparent to those skilled in the art to which this invention relates from the subsequent description of the preferred embodiments and the appended claims, conjunction with the accompanying drawings.

DETAILED DESCRIPTION OF THE INVENTION

Figure 1:
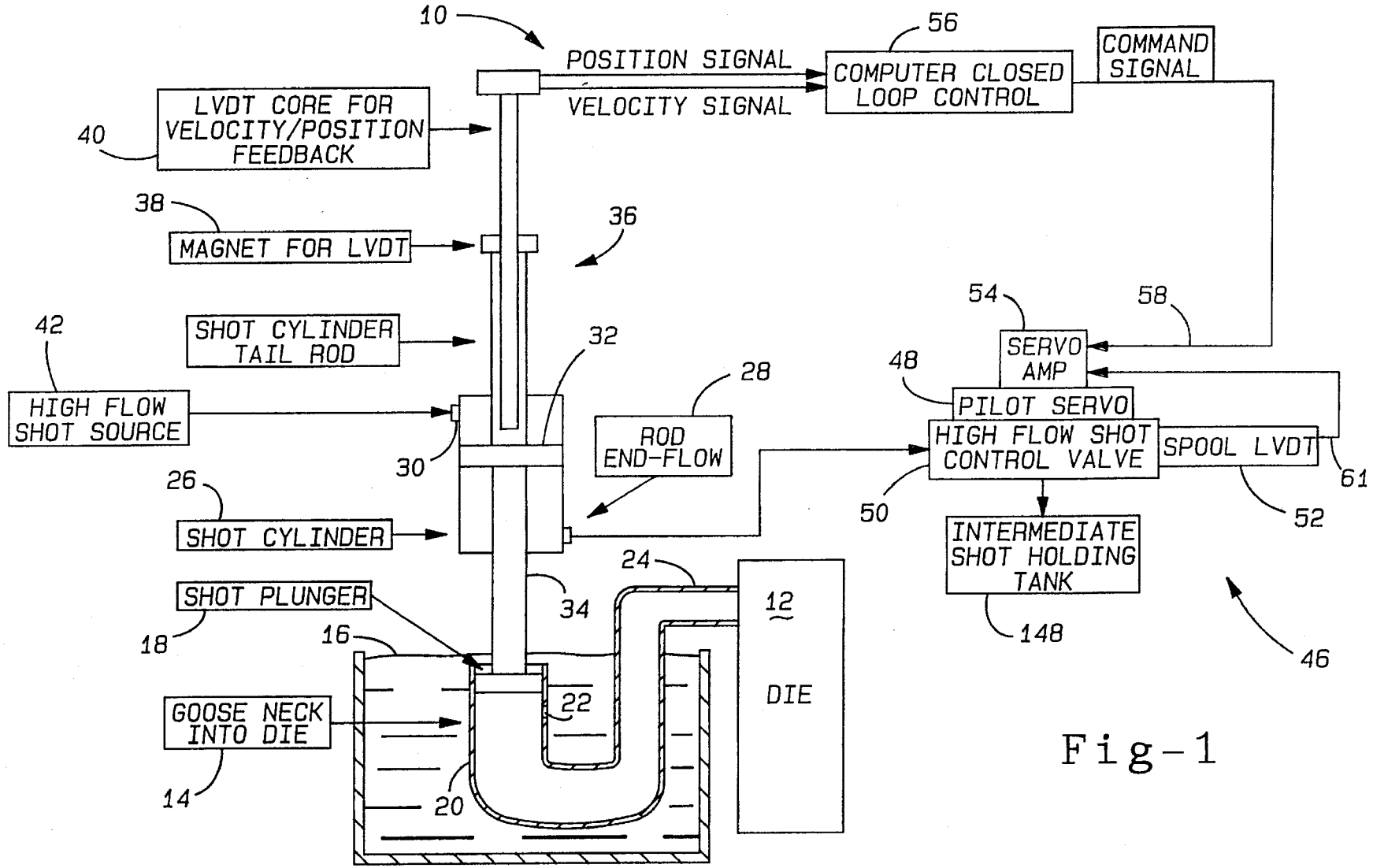
FIG. 1 is a schematic diagram of the primary elements of a die cast shot system including the control system of this invention.

With reference to FIG. 1 a die cast shot system in accordance with this invention is shown in schematic fashion and is generally represented by reference number 10. Shot system 10 represents a typical zinc machine with a vertical shot cylinder. As mentioned previously, shot system 10 controls the shot process in a die casting operation. A representative die 12 is shown in FIG. 1 which is supplied with molten metal through a goose neck assembly 14. Goose neck assembly 14 is immersed in a pool of molten die cast metal 16. The shot process is controlled through movement of shot plunger 18 which acts as a hydraulic ram as it moves vertically within the cylindrical portion 20 of goose neck assembly 14. Shot plunger 18 is shown in FIG. 1 in a raised position which permits molten metal to fill goose neck assembly 14 through fill port 22. During a shot process shot plunger 18 is forced in a downward direction until it passes across fill port 22. From that point continued downward movement of shot plunger 18 forces molten metal into die 12.

Shot cylinder 26 provides the force to drive shot plunger 18. As shown, shot cylinder 26 is a generally conventional double-acting hydraulic cylinder having rod end port 28 and cap end port 30 on opposite sides of cylinder piston 32. Shot cylinder rod 34 has a tail end which extends from the cylinder forming linearly variable differential transformer (LVDT) 36 which includes magnet 38 and core 40. LVDT 36 provides an accurate measure of the precise position of shot plunger 18 and is used as part of the closed loop control system which will be described in more detail below.

In the operation of shot system 10 of this invention a constant high flow shot source 42 of hydraulic fluid is applied to shot cylinder cap end port 30. Control over movement of shot plunger 18 is provided by metering the flow of hydraulic fluid out of rod end port 28. In one representative embodiment of this invention a supply pressure of 1200 psi is supplied to shot cylinder 26, generating a maximum pressure on the die cast metal of around 2400 psi.

The control system used to control the metering out of flow of hydraulic fluid from rod end port 28 of shot cylinder 26 defines the principal feature of the present invention. The control system is generally designated by reference number 46 and principally comprises pilot servo-valve 48, high flow shot control valve 50, and controller 56. FIG. 1 shows an overall view of the various control and signal inputs provided for control system 46. As will be described in more detail below high flow proportional valve 50 includes spool LVDT 52 which provides an output 61 as to the position of its spool which is directly related to the flow restriction provided for the outflow of hydraulic fluid from shot cylinder rod end port 28. The signal from spool LVDT 52 is directed to servo-amplifier 54. Computer closed loop controller 56 receives position and velocity signals from shot cylinder LVDT 36. That information is processed within controller 56 to generate command signals 58 which are inputted to servo-amplifier 54. Servo-amplifier 54 compares the controller command signal 58 with the position detected through spool LVDT 52 and generates control signal 60 which is inputted in an amplified state into pilot servo-valve 48 which in turn operates high flow proportional valve 50.

Figure 2:
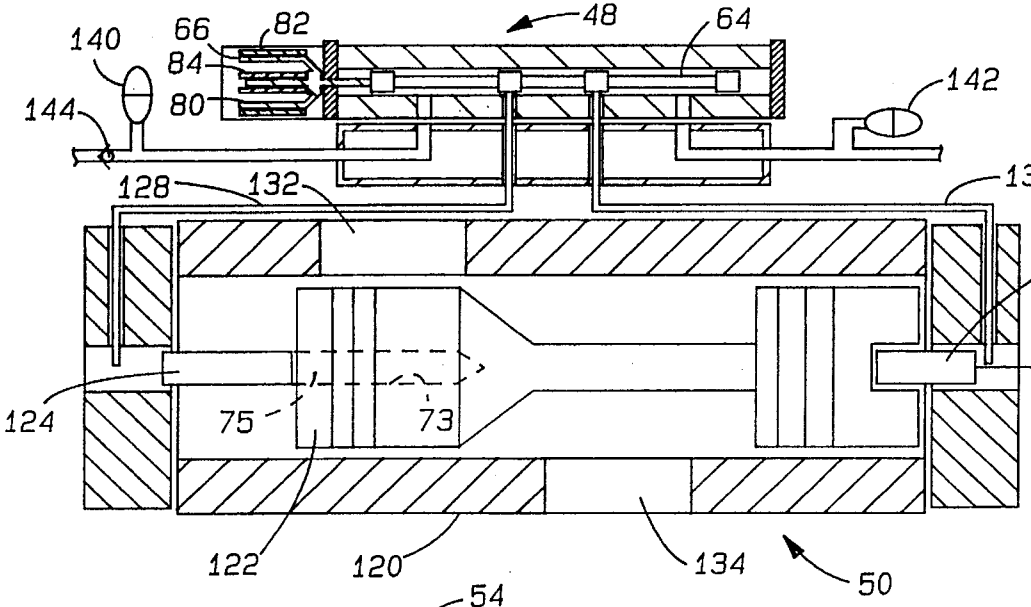
FIG. 2 is a schematic diagram of the voice coil driven servo-valve and high flow proportional valve of the shot control system of this invention.
Figure 5:
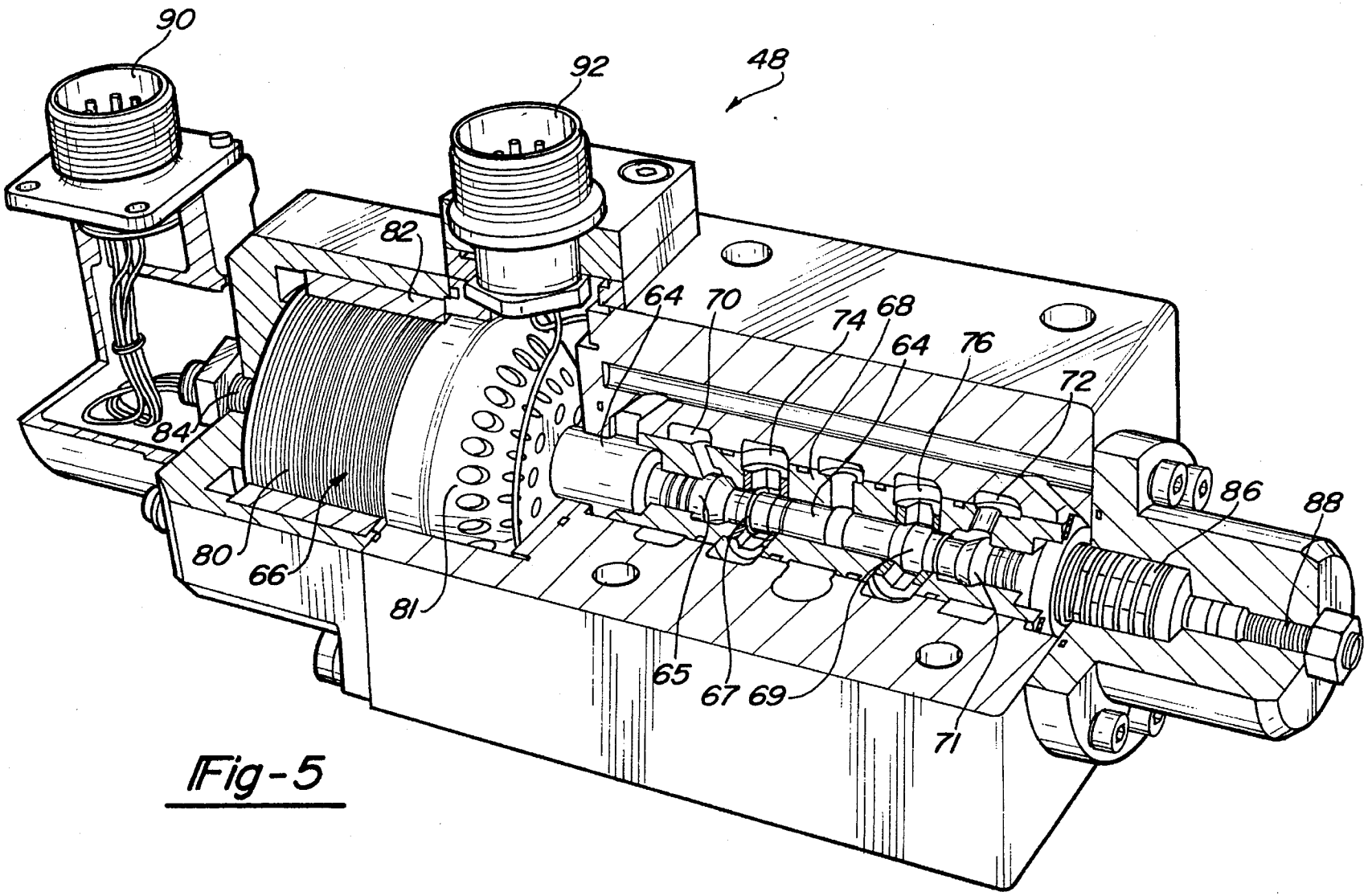
FIG. 5 is a pictorial view of the voice coil pilot servo-valve of this invention shown partially cut-away in section showing the internal components thereof.

Pilot servo-valve 48 is shown schematically in FIG. 2 and in more detail in FIG. 5. Pilot servo-valve is a single stage type valve with a four-way sliding spool 64 which is directly driven through a mechanical link by a voice coil type force motor 66. Spool 64 fits within sleeve 68. Four separate flow channels are provided. A high pressure supply port supplies hydraulic fluid to passageway 70 at the left-hand end of spool 64. A pilot servo tank return line passageway 72 communicates with a reservoir of hydraulic fluid. Two control ports are provided which communicate with control port passages 74 and 76, respectively. Spool 64 forms lands 65, 67, 69 and 71 which separate the passageways with spool grooves between them. As spool 64 moves in the left-hand direction, control port 76 communicates with the tank outlet 72 and passageway 74 is blocked from supply passageway 70, whereas positioning in the right-hand direction closes connection with the tank and applies pressure from the supply to control port 74. By precisely controlling the translation of spool 64, highly accurate control over port 74 and 76 is provided.

Voice coil force motor 66 consists of coil 80 which moves relative to fixed magnet 82. Coil 80 is wrapped on bobbin 81 which is directly attached to spool 64. Within moving coil 80 is provided elements of LVDT 84 which directly senses the position of spool 64. Spool 64 is biased to a neutral position through a pair of opposing coil springs with spring 86 mounted on the end of spool 64 opposite voice coil 66 and another spring within moving coil 80 (not shown). The force exerted by spring 86 is adjusted by the threaded adjustment stud 88. A pair of electrical connectors are provided with electrical connector 90 provided for LVDT 84 and connector 92 for voice coil 80.

Figure 3:
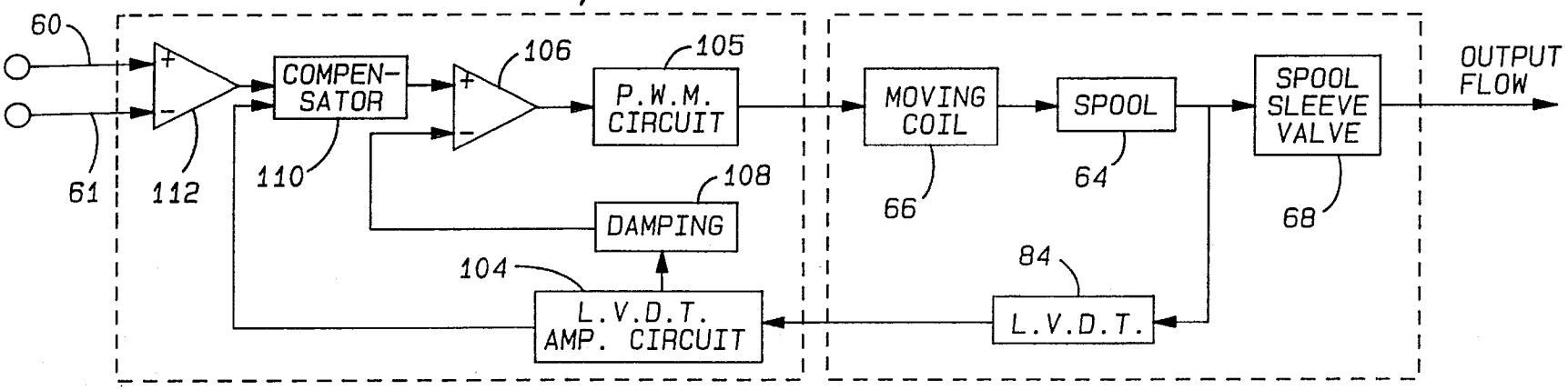
FIG. 3 is a electrical schematic diagram of the control system of the servo-amplifier and servo-valve shown in FIG. 1.

The servo-amplifier 54 is provided directly mounted to pilot servo valve 48. Servo amplifier 54 is shown in pictorial fashion in FIG. 3 along with a graphical representation of pilot servo valve 48. As shown, servo amplifier 54 includes LVDT amplifier circuit 104 which receives an input from LVDT 84. Power is applied to voice coil 80 through a pulse width modulation (PWM) circuit 105 which provides a duty cycle modulated signal for creating a force acting on spool 64. Pre-amp 106 receives a signal from LVDT amplifier 104 which is buffered by a damping component 108 which provides another input into pre-amp 106. Compensator 110 receives the control signal 60 described previously which is fed into pre-amp 112, along with feedback signal via LVDT 52, namely signal 61, 61 which is therein compared with the command signal 58. As spool 64 approaches a target position, the output signal of pre-amp 106 is adjusted and the driving current from PWM circuit 105 applies an adjusted signal to coil 80.

Figure 4:
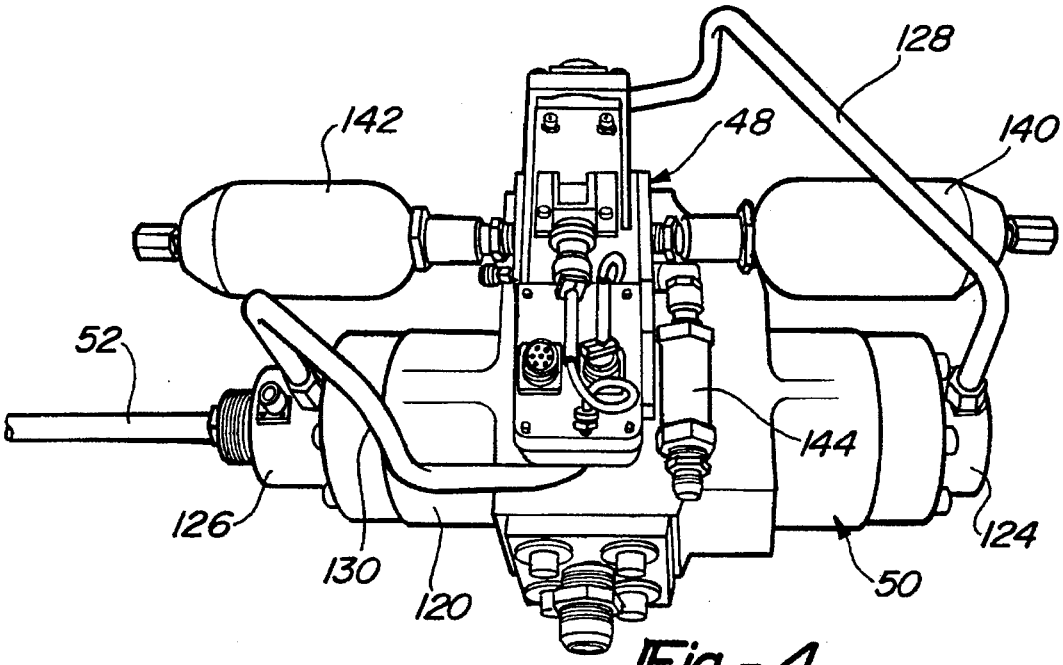
FIG. 4 is an elevational view of the voice coil driven pilot servo-valve and high flow proportional valve combination of this invention.

Pilot servo valve 48 is mounted directly to a ground surface on high flow proportional valve 50 as best shown in FIG. 4. Proportional valve 50 includes housing 120 having a high flow metering spool 122 which is moveable therein. Acting on opposite ends of metering spool 122 is a pair of shift control pistons 124 and 126 which are connected via external pipes 128 and 130 to pilot-servo control port passageways 74 and 76, respectively. Spool 122 is made lighter by drilling bore 73 which is closed off by cap 75. High flow proportional valve 50 inlet port 132 is directly connected to shot cylinder rod end port 28. Shifting of high flow metering spool 122 modulates the restriction imposed on the flow of fluid from inlet port 132 to outlet port 134 which is connected to shot tank 148. Spool LVDT 52 is shown schematically connected with metering spool 122 and provides the output signal 61 as shown in FIG. 1 to servo-amplifier 54.

Through closed loop adjustment of the position of pilot servo spool 48, the pressures applied on opposite ends of high flow metering spool 122 are adjusted, causing it to shift laterally in its bore. Through movement in the right-hand direction, a greater restriction to outlet flow is provided, whereas movement in the left-hand direction produces a decreased restriction. Through precise control over the position of high flow metering spool 122, accurate control over shot cylinder 26 is provided. In an embodiment of this invention, pilot servo valve 48 exhibited a step response of zero to full flow in only 6–8 ms, which operates proportional valve 50 to move from zero to full flow in only 12–18 ms.

In addition to the basic configuration of control system 46 several other features also contribute to the system's outstanding frequency response characteristics and stability. Pipes 128 and 130 as well as shift control pistons 124 and 126 have an intentionally limited retained volume which reduces the hydraulic column acting between pilot servo valve 48 and proportional valve 50. In experimental embodiments of this invention a proportional valve 50 capable of 1000 gpm, shift controls pistons 124 and 126 which have a 3.0 $in^3$ maximum volume, whereas a valve of 2500 gpm capability has pistons of a 14.0 $in^3$ maximum volume. In addition, a pair of nitrogen charged bladder type accumulators 140 and 142 are provided for maintaining stability of pilot pressure supplied to and exhausted from pilot servo-valve 48. Accumulator 140 acts on the high pressure supply port on the pilot servo-valve. Check valve 144 ensures that accumulator 140 will charge. Accumulator 142 is placed on the tank side return line of pilot servo-valve 48. Accumulators 140 and 142 isolate the pilot servo-pressure supply line and tank line from shock when pilot servo-valve 48 is suddenly opened.

Figure 6:
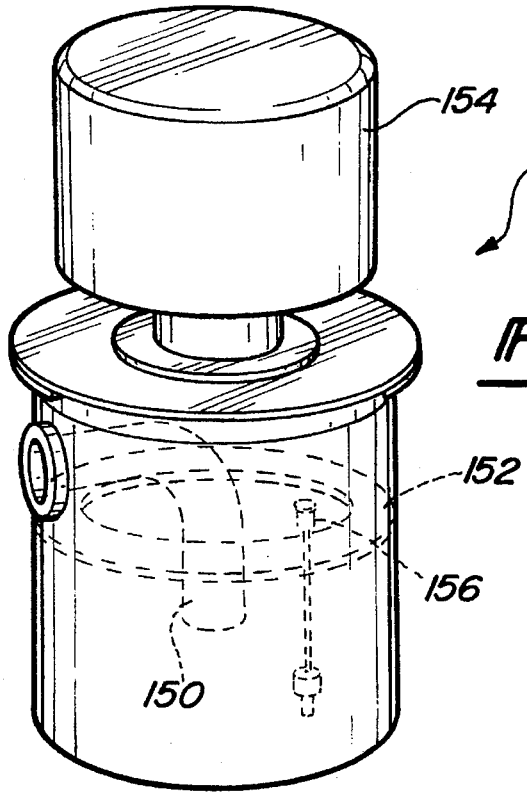
FIG. 6 is a pictorial view of the shot accumulator of this invention.

Shot tank 148 provides a high capacity accumulator for receiving hydraulic fluid from shot cylinder 26 without imposing a significant back pressure. As shown in FIG. 6, shot tank 148 includes a downwardly directed inlet elbow 150. Shot tank 148 has a fluid capacity greater than the fluid displaced by shot cylinder 26 in a single cycle of operation. Perforated diffuser 152 controls splashing of incoming hydraulic fluid. Breather 154 vents the tank. Float switch 156 provides a control signal to empty shot tank 148 as needed. Shot tank 148 is mounted directly to proportional valve 50 to minimize flow restriction.

FIG. 4 is a pictorial view of control system 46 separated from the components of shot control system 10 and showing the external appearance of the number of the features previously described.

While the above description constitutes the preferred embodiments of the present invention, it will be appreciated that the invention is susceptible of modification, variation and change without departing from the proper scope and fair meaning of the accompanying claims.

I claim:

1. A hydraulic control system for a die casting machine of the type having a shot cylinder with first and second ports and applying a force on a shot plunger for forcing molten metal into a casting die, said control system comprising:

a source of hydraulic fluid acting on said shot cylinder first port for applying a force on said shot plunger urging said shot plunger to force said molten metal into said die, a servo valve having a single translatable servo spool for metering a servo control pressure source and a return line providing first and second servo control pressure signals, said servo spool being urged to translate by direct mechanical connection to a voice coil actuator having a permanent magnet affixed to a housing of said servo valve and a relatively moveable coil which is directly affixed to said servo spool such that they move linearly together, said servo valve further having a first position transducer providing a first output signal related to positioning of said servo spool, a proportional spool valve having a metering spool translatable in response to first and second shift control pistons acting on opposite ends of said metering spool, said metering spool providing a variable restriction for flow of said hydraulic fluid from said shot cylinder second port thereby controlling pressure differentials acting on said shot plunger and thus controlling forcing of molten metal into said casting die, said proportional valve further having a second position transducer providing a second output signal related to positioning of said metering spool, conduit means for communicating said first and second servo control pressure signals with said first and second shift control pistons thereby enabling said servo valve to control said proportional spool valve to provide control of said variable restriction, and a third position transducer coupled to said shot plunger and providing a position signal related to the position of said shot plunger, said position signal and said second output signal resulting in a control signal, said control signal being utilized in conjunction with said first output signal for causing movement of said movable coil in response thereto, a first hydraulic accumulator in said servo valve control pressure source, a second hydraulic accumulator in said servo valve control pressure return, an intermediate holding mounted directly to said proportioned spool valve and having a fluid capacity greater than the capacity of said shot cylinder; and controller means for receiving said position signal and said second output signal and producing said control signal as a result thereof, said controller means also receiving said first output signal, said first output signal and said control signal being utilized by said control means to generate a signal to be applied to said voice coil thereby enabling control over said shot cylinder.

* * * * *